US005329783A

United States Patent [19]

Yang

[11] Patent Number: 5,329,783

[45] Date of Patent: Jul. 19, 1994

[54] AIR CONDITIONING APPARATUS

[75] Inventor: Ten S. Yang, Taipei, Taiwan

[73] Assignee: Fast Maker Enterprise Co., Ltd., Keelung, Taiwan

[21] Appl. No.: 987,782

[22] Filed: Dec. 9, 1992

[51] Int. Cl.[5] ..... F25B 39/04

[52] U.S. Cl. ..... 62/183; 62/238.6; 62/299

[58] Field of Search ..... 62/238.6, 238.7, 181, 62/183, 184, 299

[56] References Cited

U.S. PATENT DOCUMENTS

| | | | |
|---|---|---|---|
| 2,518,299 | 8/1950 | Fernandez | 62/299 |
| 2,894,377 | 7/1959 | Shikles, Jr. et al. | 62/299 X |
| 3,507,322 | 4/1970 | Tetrick et al. | 62/299 X |
| 3,992,896 | 11/1976 | Janson et al. | 62/299 X |
| 4,270,359 | 6/1981 | Hummel | 62/238.7 X |
| 4,293,093 | 10/1981 | Raymond et al. | 62/238.6 X |
| 4,327,561 | 5/1982 | McNeal et al. | 62/238.6 X |
| 4,588,026 | 5/1986 | Hapgood | 62/238.7 X |
| 4,697,434 | 10/1987 | Yuyama | 62/238.7 |
| 5,004,047 | 4/1991 | Meier et al. | 62/238.7 X |

*Primary Examiner*—Harry B. Tanner

*Attorney, Agent, or Firm*—Morton J. Rosenberg; David I. Klein

[57] ABSTRACT

This invention relates to an air conditioning apparatus and in particular to one including a compressor, an evaporator, a cooling fan, a low pressure pipe, a high pressure pipe, a radiator, a cooling motor, and a condenser. The apparatus is characterized in that the heat exchanging efficiency between the cooling water and the refrigerant is highly enhanced, thereby intensifying the cooling effect and increasing the temperature of the cooling water flowing out of the apparatus to an acceptable degree for residential hot water. Further the radiator may be separated from the apparatus thus making it suitable for use in varied applications.

4 Claims, 6 Drawing Sheets

AIR CONDITIONING APPARATUS

BACKGROUND OF THE INVENTION

It has been found that the small air conditioners on the market are cooled by air and so the efficiency thereof is very low thereby wasting much energy. Further, the heat exhausted by such air conditioners will pollute and increase the temperature of the environment. As to the large air conditioners on the market, they are usually cooled by water. However, the heat of the refrigerant exchanged with the cooling water in these air conditioners still are not fully utilized.

Therefore, it is an object of the present invention to provide an air conditioning apparatus which may obviate and mitigate the above-mentioned drawbacks.

SUMMARY OF THE INVENTION

This invention relates to an improved air conditioning apparatus.

It is the primary object of the present invention to provide an air conditioning apparatus which utilizes a condenser with a special coil pipe to increase the heat exchanging efficiency thereby increasing the cooling effect and the temperature of the cooling water flowing out of the apparatus to an acceptable degree.

It is another object of the present invention to provide an air conditioning apparatus of which the radiator may be separated from the apparatus.

It is still another object of the present invention to provide an air conditioning apparatus which may supply hot water to the user.

It is still another object of the present invention to provide an air conditioning apparatus which may save a lot of energy.

It is still another object of the present invention to provide an air conditioning apparatus which is economic to produce.

Other objects and merits and a fuller understanding of the present invention will be obtained by those having ordinary skill in the art when the following detailed description to the preferred embodiment is read in conjunction with the accompanying drawings.

DETAILED DESCRIPTION OF THE PREFERRED EMBODIMENT

Figure 1:
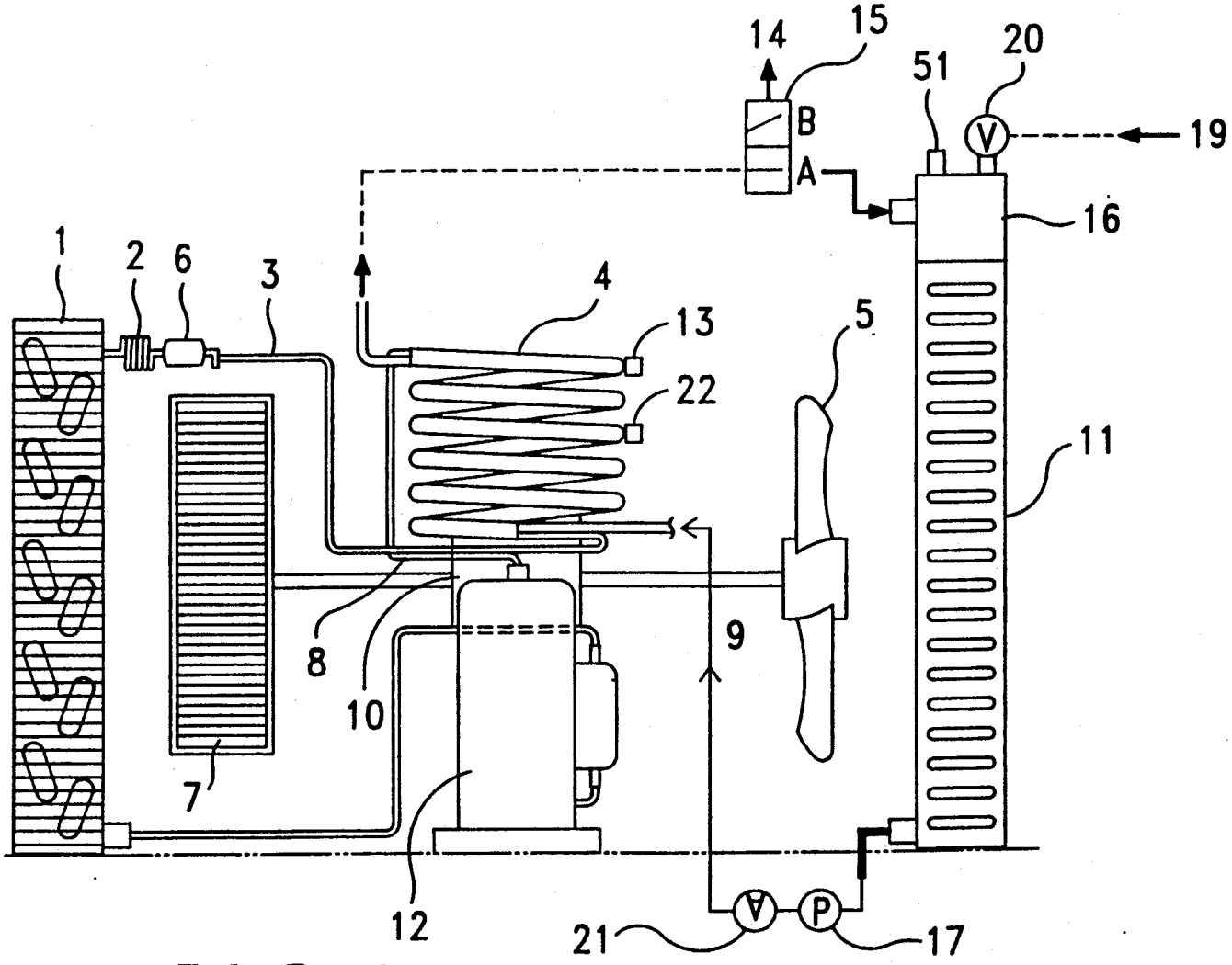
FIG. 1 is a schematic diagram of the present invention.

With reference to the drawings and in particular to FIG. 1 thereof, the present invention mainly comprises a compressor 12, an evaporator 1, a cooling fan 7, a condenser outlet pipe 3, a condenser inlet pipe 8, a radiator 11, a cooling motor 10, a condenser 4, a first sensor 13, and a second sensor 22.

The compressor 12 is used to compress the refrigerant, which is well known in the art and need not be described here in detail.

The evaporator 1 is a device where the liquid refrigerant is evaporated rapidly thereby providing a cooling effect. Further, the evaporator 1 is connected to the condenser 4 through the condenser outlet pipe 3, a filter 6 and a capillary tube 2.

The cooling fan 7 is mounted beside the evaporator 1 and is used to make a current of air across the evaporator 1 thereby lowering the temperature of the air current.

The condenser outlet pipe 3 is used to connect the outlet at the lower portion of the condenser 4 with the evaporator 1 so as to transmit the liquid refrigerant from the condenser 4.

The radiator 11 is provided with a water tank 16 and utilizes a pump 17 to force the cooling water to flow through a throttle valve 21 into the coil pipe of the condenser 4. Then, the cooling water will flow into the water tank 16 under the selection control of a three-way solenoid valve 15 or will flow out from the hot water outlet 14 of the three-way solenoid valve 15.

The cooling motor 10 is used to drive the cooling fan 5 to make air current across the radiator 11 so as to further lower the temperature thereof.

The condenser 4 is a coil pipe which the high temperature and high pressure refrigerant will be forced into and will become liquid in.

The first sensor 13 is mounted on the upper portion of the condenser 4 for detecting the temperature flowing out of the condenser 4 and is used to control the opening of a water control valve 20. In addition, the first sensor 13 is set at a temperature such as, for example, of 50 degrees centigrade, so that when the temperature of the water exceeds 50 degrees centigrade, the water control valve 20 will be turned open at a larger degree, so as to increase the amount of water into the condenser 4 from the water supplying source 19.

The second sensor 22 is installed approximately on the intermediate portion of the coil pipe of the condenser 4 and located under the first sensor 13. The second sensor 22 is used to control the shut-off of the water control valve 20 and set at a temperature such as, for example, of 45 degrees centigrade so that when the water temperature is below 45 degrees centigrade, the water control valve 20 will be turned open at a smaller degree thereby keeping the water at a temperature between 45–50 degrees centigrade.

The present invention resides in four characteristics, i.e. the structure of the coil pipe of the condenser, the structure of the radiator, the hot water supplying system, and the rapid connector. The characteristics will be described in detail as follows.

Figure 2A:
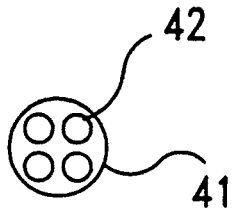
FIG. 2A shows the cross section of a first preferred embodiment of the coil pipe.
Figure 2B:
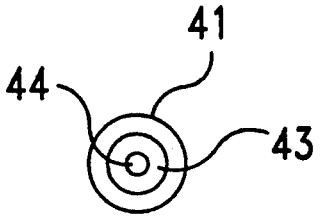
FIG. 2B shows the cross section of another preferred embodiment of the coil pipe.
Figure 2:
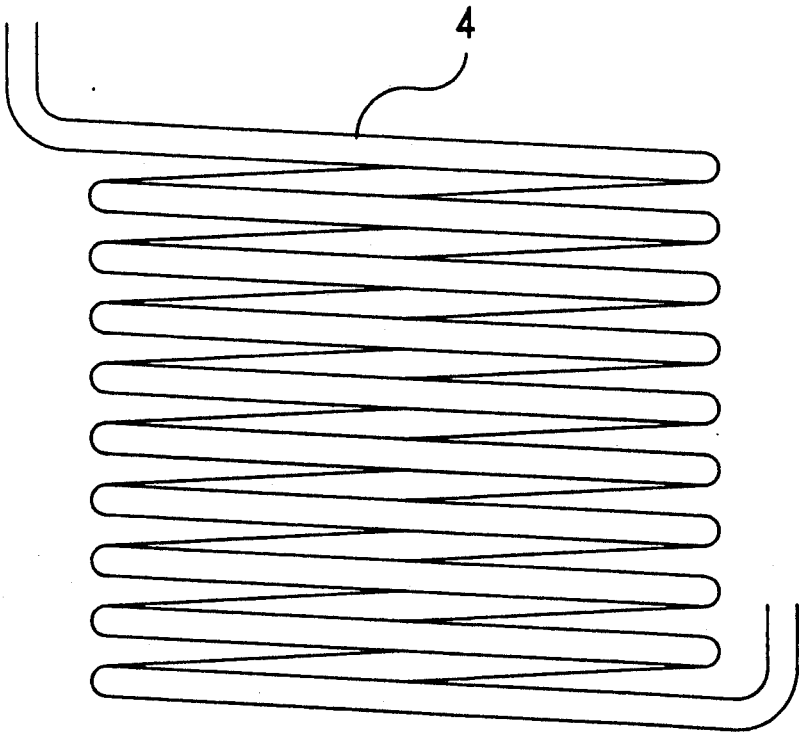
FIG. 2 is a front view of the coil pipe of the condenser.

As illustrated in FIGS. 2 and 2A, the condenser 4 is composed of a coil pipe which includes an outer pipe 41 and a plurality of inner pipes 42. The relationship between the outer pipe 41 and the inner pipes 42 is that the center lines of these pipes 41 and 42 are not coincident with each other. That is, a plurality of inner pipes 42 with smaller diameter than the outer pipe 41 are inserted into the outer pipe 41. The inner pipes 42 are designed for the passage of cooling water while the outer pipe 41 for the passage of high temperature and high pressure refrigerant. Thus, the heat exchanging area between the refrigerant and the cooling water will be equal to the sum of the outer surface areas of the inner pipes 42 thereby effectively increasing the temperature of the cooling water. Hence, the refrigerant may be effectively reduced in temperature at one hand, and the cooling water may be effectively increased at the other.

FIG. 2B shows another preferred embodiment of the coil pipe of the condenser 4. As may be seen, the coil pipe of the condenser 4 is composed of an outer pipe 41, an intermediate pipe 43 and an inner pipe 44. The relationship between the outer pipe 41, the intermediate pipe 43 and the inner pipe 44 are that their center lines lie on the same axis. In short, the inner pipe 44 is inserted into the intermediate pipe 43 and the intermediate pipe 43 is in turn inserted into the outer pipe 41. The inner pipe 44 and the outer pipe 41 are designed for the passage of cooling water, while the intermediate pipe 43 for the passage of high temperature and high pressure refrigerant. Hence, the heat exchanging area between the refrigerant and the cooling water will be equal to sum of the outer area of the intermediate pipe 43 and the outer area of the inner pipe 44.

Figure 3:
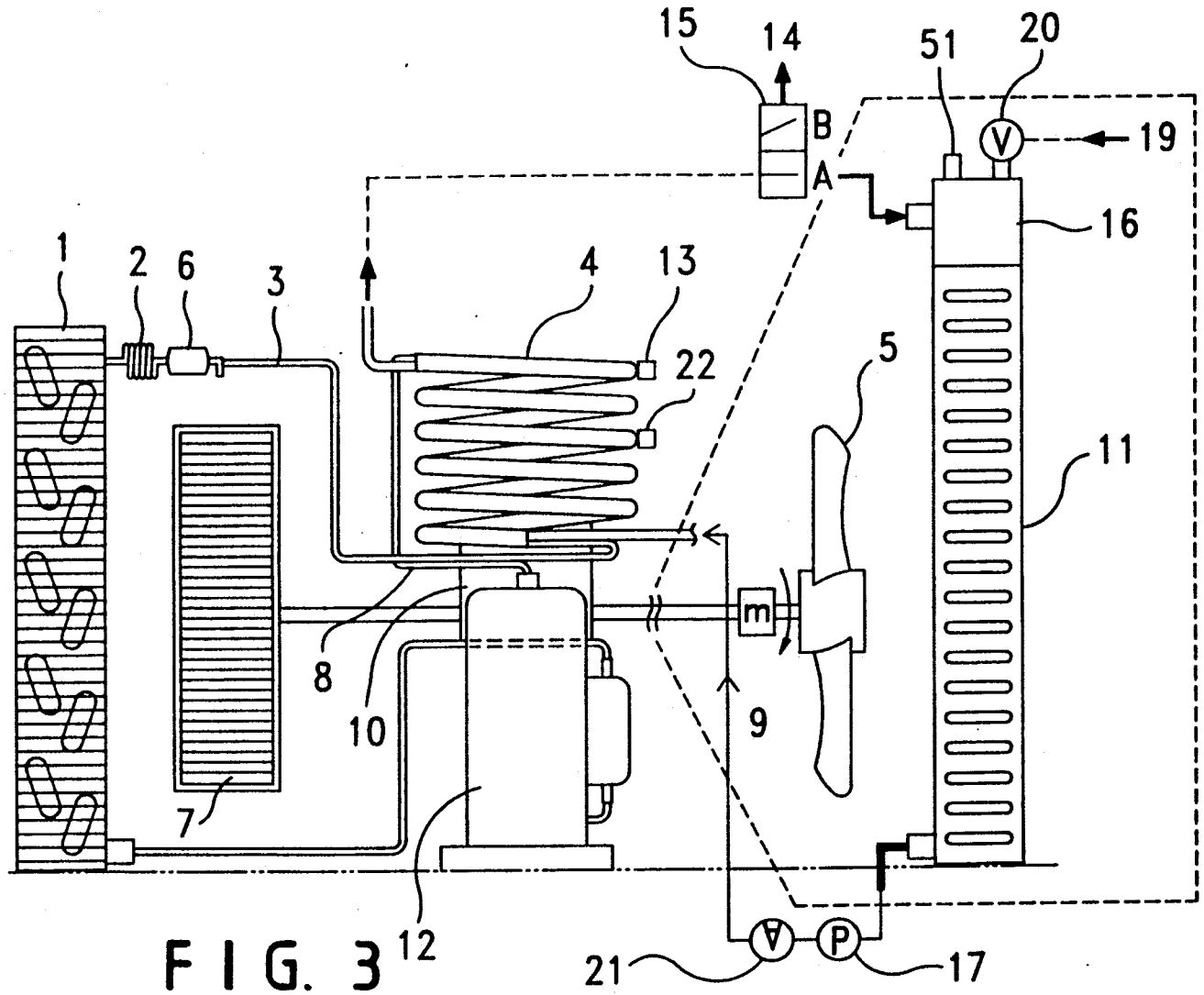
FIG. 3 shows the way to separate the radiator together with the cooling fan from the apparatus.

The other characteristic of the present invention resides in the structure of the radiator ! ! . As shown in FIG. 3, the water from the water supplying source 19 will first flow into the water tank 16 through the water control valve 20 and then into the radiator 11. Then, the pump 17 will force the cooling water to flow through the throttle valve 21. Thereafter, the cooling water will enter into the coil pipe of the condenser 4 via the water inlet 9, where the cooling water exchanges heat with the high temperature and high pressure refrigerant. Thus, the cooling water becomes hot water and flows out of the coil pipe of the condenser 4. Then, the cooling Water will flow into the water tank 16 and the radiator 11. The fan 5 is used to expedite the cooling of the radiator 11 and the cooling water is circulated. Further, the cooling fan 5 and the radiator 11 may be separated from the apparatus so as to be adapted for use in various circumstances. When desired to use hot water, the three-way solenoid 15 is controlled to cause the hot water to flow out of its hot water outlet 14.

Figure 4:
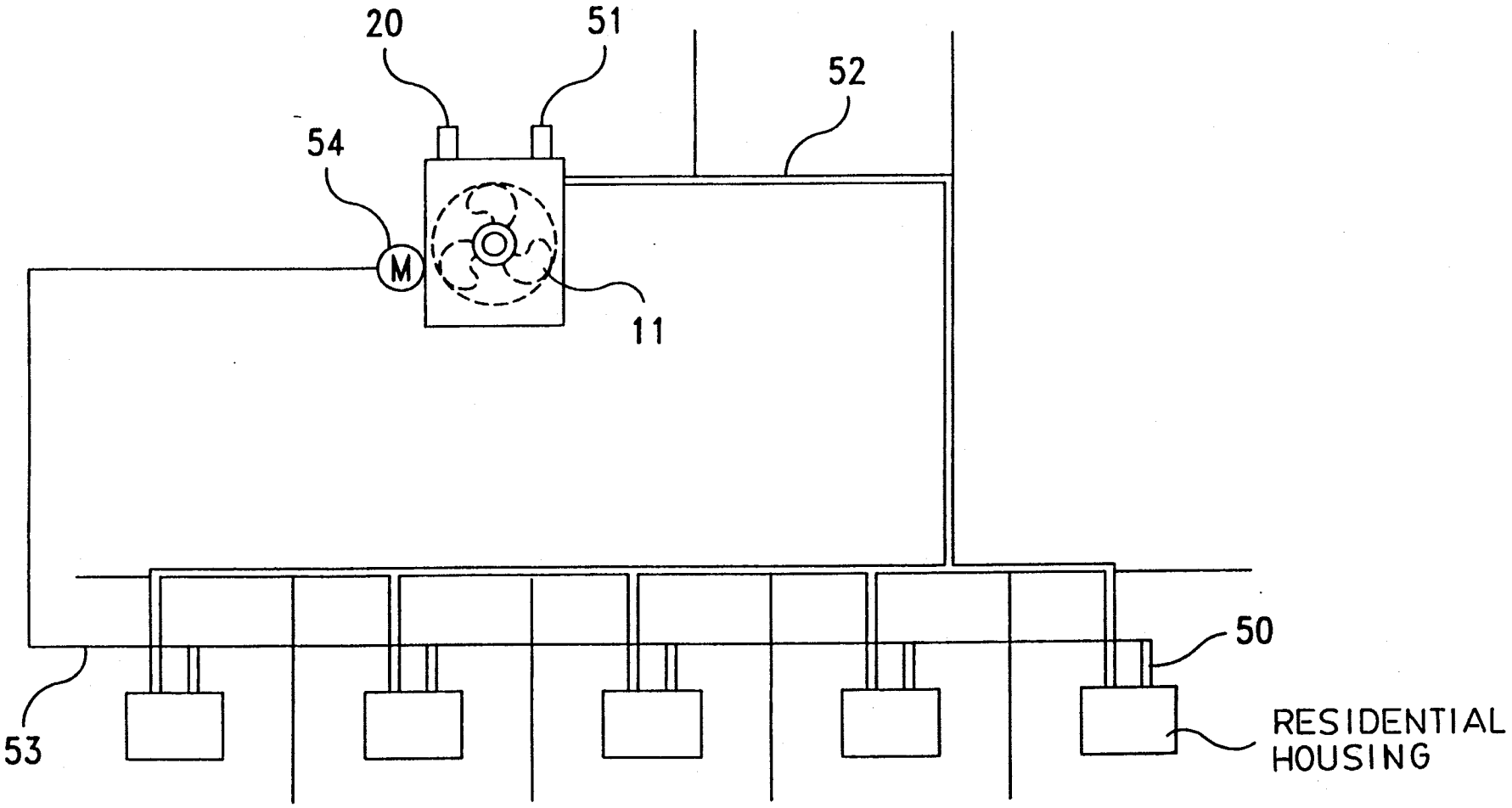
FIG. 4 illustrates the way to supply hot water from the present invention to the hot water piping of a house.

The third characteristic of the present invention resides in the retrieval of the cooling water after exchanging heat with the refrigerant thereby saving energy and reducing heat pollution. As illustrated in FIG. 4, the cooling fan 5 and the radiator 11 are separated from the apparatus and connected with the water outlet of the apparatus via piping 52 and with the water inlet of the apparatus via piping 53. The piping 52 is connected with the hot water supplying piping of residential housing so that when the hot water faucet is open, the hot water derived from the cooling water, by exchanging heat with the refrigerant will be transmitted to the hot water faucet through the piping 52. Further, the water tank 16 is provided with a float bowl 51 for measuring the water level. As the water level is found lowered than a predetermined value, the float bowl 51 will send a signal to open the water inlet control valve 20 so as to supplement water from the water supplying source 19. When it is not desired to use hot water, the cooling water from the present invention will flow back into the water inlet 50 and will be circulated therein.

Figure 5:
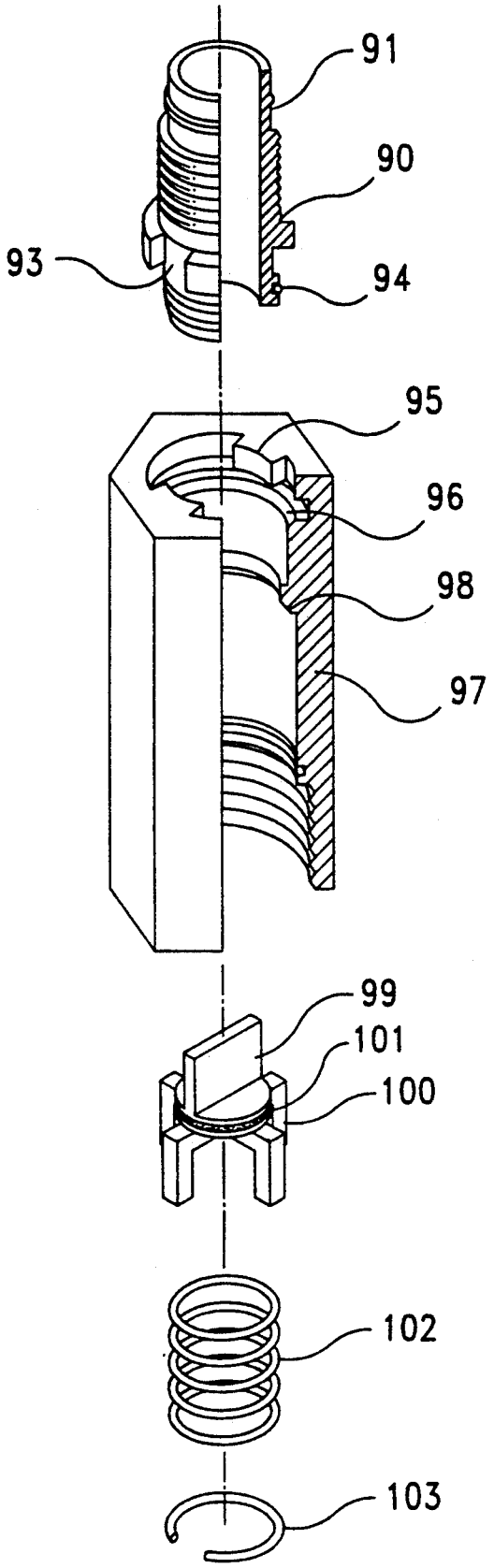
FIG. 5 is an exploded view of a rapid connector.
Figure 6:
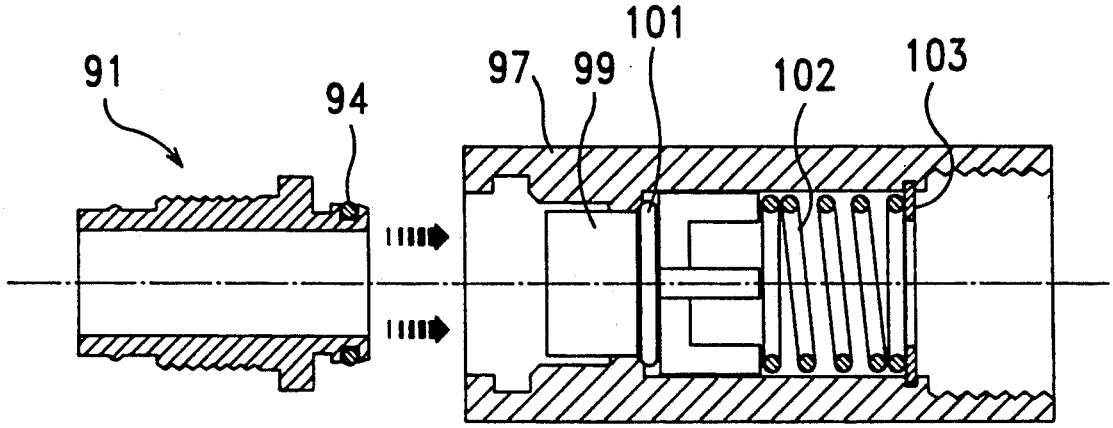
FIGS. 6 and 6A show the working principle of the present invention.
Figure 6A:
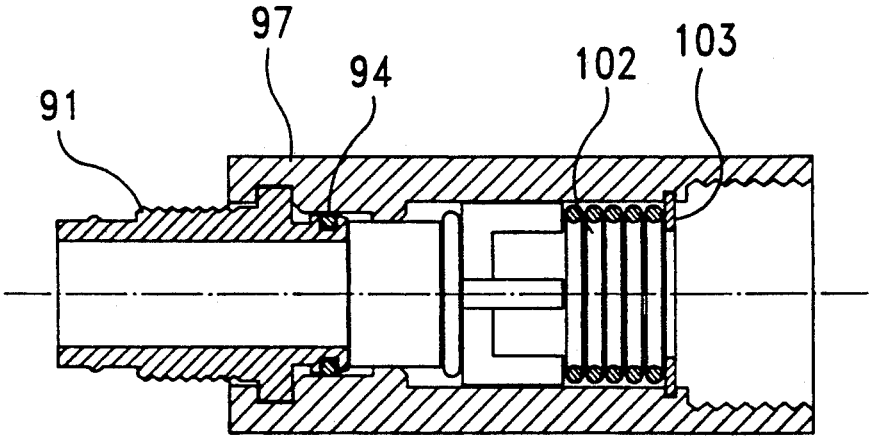

The fourth characteristic of the present invention is directed to a rapid connector which is used to connect a water supplying source 19 to the water tank 16. Referring to FIGS. 5, and 6A, the rapid connector mainly comprises a male member 90, a female member 97, a latch bolt 99, and a spring 102. The female member 97 is connected with the water supplying source by screw threads or the like and is formed with two opposite protuberances 95, an upper inclined edge 96 under the protuberances 95, and a lower inclined edge 98 under the upper inclined edge 96. The intermediate portion of the latch bolt 99 is provided with a rubber ring 101 adapted for engaging with the lower edge 98 of the female member 97. The male member 90 has an end 91 for engaging with a flexible pipe (not shown), two opposite slots 93 adapted to receive the protuberances 95 of the female member 97, and a rubber ring 94 for engaging with the upper inclined edge 96 of the female member 97.

In use, the female member 97 is connected with the water supplying source and the male member 90 is connected with the flexible pipe connected with the water control valve 20. In the meantime, the rubber ring 101 will bear against the lower edge 98 of the female member 97 thereby preventing water leakage.

For coupling the male and female members, the slots 93 of the male member 90 are aligned with the protuberances 95 of the female member 97 and then the male member 90 is rotated so as to prevent the male member 90 from detaching from the female member 97. As the male member 90 is inserted into the female member 97, the rubber ring 94 of the male member 90 will first bear against the upper inclined edge 96 of the female member 97 so as to prevent water from leaking out of the female member 97. Then, as the male member 90 is further inserted into the female member 97, the latch bolt 99 will be forced to go backward and so the rubber ring 101 of the latch bolt 99 will no longer bear against the lower inclined edge 98 of the female member 97 thereby enabling water to flow into the male member 90 through the clearance between the latch bolt 99 and the female member 97. When not is use, the male member 90 is rotated to align the slots 93 with the protuberances 95 and the male member 90 is then withdrawn from the female member 97. Meanwhile, the spring 102 will urge the latch bolt 99 to go upwards and the rubber ring 101 will bear against the lower inclined edge 98 of the female member 97 thereby preventing water from spraying out of the female member 97.

Although the present invention has been described with a certain degree of particularity, it-is understood that the present disclosure is made by way of example only and that numerous changes in the detail of construction and the combination and arrangement of parts may be resorted to without departing from the spirit and scope of the invention as hereinafter claimed.

I claim:

1. An air conditioning system, comprising:

a compressor for pressurizing a refrigerant, said compressor having an inlet port and an outlet port;

an evaporator having an outlet port fluidly coupled to said compressor inlet port;

condensing means having a refrigerant input line coupled in fluid communication with said compressor outlet port and a refrigerant output line coupled in fluid communication with an inlet port of said evaporator for condensing said refrigerant from a gaseous state at a first temperature to a liquid state at a second temperature, said first temperature being higher than said second temperature, said condensing means including (1) a first conduit having opposing first and second ends for carrying a coolant therethrough, (2) a second conduit extending in concentric spaced relation through said first conduit, said second conduit being fluidly coupled to said refrigerant input line on one end thereof and fluidly coupled to said refrigerant output line on an opposing end for carrying said refrigerant therebetween, and (3) a third conduit extending in concentric spaced relation through said second conduit for carrying said coolant therethrough, said third conduit having a first end coupled in fluid communication with said first end of said first conduit and a second end coupled in fluid communication with said second end of said first conduit, wherein heat from said refrigerant in said second conduit is transferred to said coolant within both said first and third conduits; and means for displacing said coolant coupled in closed loop fluid communication with both said first and third conduits, sand coolant displacement means including (1) a coolant pump having an outlet coupled in fluid communication with said first end of said of said first and third conduits, (2) a radiator having an outlet coupled in fluid communication with an inlet of said coolant pump and a first coolant inlet coupled in fluid communication with said second end of each said first and third conduits, and (3) means for cooling said radiation.

2. The air conditioning system as recited in claim 1 where said coolant displacement means further includes means for maintaining and condensing means within predetermined temperature limits, said temperature maintenance means including (1) a first temperature sensor disposed on said condensing means for detecting a temperature of said coolant adjacent said second end of said first conduit, and (2) a second temperature sensor disposed on said condensing means for detecting a temperature of said coolant intermediate said first and second ends of said first conduit.

3. The air conditioning system as recited in claim 1 where said coolant displacement means further includes valve means coupled in fluid communication with said second end of each of said first and third conduits for removing coolant therefrom.

4. The air conditioning system as recited in claim 1 where said radiator includes a second coolant inlet coupled in fluid communication with a coolant source, said second coolant inlet including a quick disconnect connector having (1) a male member fluidly coupled to said second coolant inlet, (2) a female member fluidly coupled to said coolant surface, and (3) a spring biased valve disposed within an axial through bore formed in said female member, said spring biased valve being displaced responsive to insertion of said male member into said axial bore of said female member.

* * * * *